US006244459B1

(12) United States Patent
Bouc et al.

(10) Patent No.: US 6,244,459 B1
(45) Date of Patent: Jun. 12, 2001

(54) BULK PACKAGING CONTAINER

(75) Inventors: Gary L. Bouc; Michael Faltys, both of Beatrice, NE (US)

(73) Assignee: Hoover Materials Handling Group, Inc., Beatrice, NE (US)

( * ) Notice: Subject to any disclaimer, the term of this patent is extended or adjusted under 35 U.S.C. 154(b) by 0 days.

(21) Appl. No.: 09/229,523

(22) Filed: Jan. 13, 1999

(51) Int. Cl.[7] ..... B65D 7/00
(52) U.S. Cl. ..... 220/630; 220/636; 220/611
(58) Field of Search ..... 220/630, 636, 220/638, 632, 611

(56) References Cited

U.S. PATENT DOCUMENTS

| | | | | |
|---|---|---|---|---|
| 4,887,731 | * | 12/1989 | Pett et al. | 220/630 |
| 5,249,684 | * | 10/1993 | Sterett | 220/630 |
| 5,253,777 | * | 10/1993 | Schutz | 220/630 |
| 5,316,174 | * | 5/1994 | Schutz | 220/630 |
| 5,597,085 | * | 1/1997 | Rauworth et al. | 220/630 |
| 5,638,983 | * | 6/1997 | Bazany | 220/642 |
| 5,657,871 | * | 8/1997 | Waters et al. | 220/630 |
| 5,823,382 | * | 10/1998 | Van Giezen et al. | 220/630 |

OTHER PUBLICATIONS

*Brochure*, Hoover Materials Handling Group, Inc.

* cited by examiner

*Primary Examiner*—Joseph M. Moy
(74) *Attorney, Agent, or Firm*—Wood, Phillips, VanSanten, Clark & Mortimer

(57) ABSTRACT

A bulk packaging container is constructed of all polymeric materials. The container is in the form of a rigid plastic intermediate bulk container or portable tank. The container comprises a base of an injection molded polymeric material having a bottom adapted to be supported from beneath and an opposite top surface to define a height of approximately six inches and including plural entry slots for forklift or pallet jack entry. A bottle of a rotationally molded polymeric material has an outer wall defining an interior storage space. The outer wall comprises a bottom wall received on the base top and a top wall including means for supporting a base of another bulk packaging container. The bottle is adapted to support weight of the other bulk packaging container.

28 Claims, 9 Drawing Sheets

BULK PACKAGING CONTAINER

FIELD OF THE INVENTION

This invention relates to a bulk packaging container and, more particularly, to a bulk packaging container constructed of all polymeric materials.

BACKGROUND OF THE INVENTION

Bulk packaging containers have found widespread use for storage and shipment of bulk goods, including hazardous materials. The bulk packaging containers assume many different forms. Among these forms are intermediate bulk containers (IBCs) and portable tanks. Requirements for these types of containers are outlined in various D.O.T. and F.D.A regulations and are particularly defined in 47 CFR Section 171.8.

Among IBCs, there include numerous types of designs. These include metal IBCs, which are constructed of metal, rigid plastic IBCs which are constructed of all plastic material, and composite IBCs which include a rigid outer packaging enclosing a plastic inner receptacle. The outer packaging may consist of, for example, a wire cage or the like. Rigid plastic IBCs are often more corrosion resistant to certain chemicals because of the lack of metal in their construction.

As with any product, cost is an important constraint. In the shipping industry, size and weight requirements are also important, as they impact on shipping costs. Rigid plastic IBCs or portable tanks may often produce the most advantageous combination among cost, size and weight.

Presently, there are available IBCs and portable tanks made of all polymeric materials. These articles include a pallet-like base and bottle mounted to the base. Both the bottle and the base are made by rotational molding. Due to necessities relating to rotational molding, the base tends to be substantially larger than desired. The larger size results in increases in costs, weight and size. Also, the use of rotational molding limits the type of resins that can be used in forming the base.

With previous designs of rigid plastic IBCs and portable tank bottles, the locations and sizes of molded openings or non-openings were limited specifically to those built into the rotational molding tool. Costly and time-consuming alterations were needed to the mold to change these combinations of molded-in openings. This limited the number of combinations of openings that could be offered to customers for reasonable cost, and in a short lead time.

IBCs and portable tanks are typically designed to be stacked during shipment and/or during storage. The rigid plastic designs often include stacking guides which helps to center the upper container over the lower container in a stack, and to help prevent the upper container from sliding off the lower container. The stacking guides are often molded integrally into the shape of the top of the bottle. In previous designs, the dimensions of the stacking guides have been several times greater than the wall thickness of the bottle. This creates a cavity on the interior upper surface of the bottle which is difficult to clean through the openings in the bottle. Given the constraints of cost and regulatory testing requirements, it is not feasible to provide openings so large that a worker could physically enter the bottle for cleaning.

Finally, in designing a bottle it is necessary to provide appropriate support to withstand horizontal forces of hoop stresses due to internal head pressure and also to withstand vertical downward forces of stacking loads without buckling. Any design must keep in mind the desire to utilize less plastic resin while producing an appropriate structural strength.

The present invention is directed to solving one or more of the problems discussed above in a novel and simple manner.

SUMMARY OF THE INVENTION

In accordance with the invention, there is provided a bulk packaging container constructed of all polymeric materials. The container is in the form of a rigid plastic intermediate bulk container or portable tank. The container comprises a base of an injection molded polymeric material having a bottom adapted to be supported from beneath and an opposite top surface to define a height of approximately six inches and including plural entry slots for forklift or pallet jack entry. A bottle of a rotationally molded polymeric material has an outer wall defining an interior storage space. The outer wall comprises a bottom wall received on the base top and a top wall including means for supporting a base of another bulk packaging container. The bottle is adapted to support weight of the other bulk packaging container. Means are provided for securing the bottle to the base.

In accordance with another aspect of the invention, a rotational mold used for forming the bottle is provided with three identical opening attachment devices which accommodate an insert to mold even the largest type of opening anticipated. All of the inserts to mold all of the types and sizes of anticipated openings are made to attach to any of these identical opening attachment devices. This allows all types and sizes of opening inserts to be quickly and inexpensively mixed and matched.

In accordance with another aspect of the invention, stacking guides integrally molded in a top wall of the bottle are uniquely designed to be filled almost completely with plastic during the rotational molding process. This is achieved through a combination of the location of the stacking guides at the comer of the bottle where there is a greater tendency for resin to collect, and the shape which is round and conical to evenly and effectively collect resin within to fill the stacking guide.

In accordance with a further aspect of the invention, the bottle is adapted to include deep ribs in the sides of the bottle running part way up the sides from the bottom and part way down the sides from the top coupled with a horizontal band which has no vertical ribs in-between. The horizontal band with no vertical ribs improves the ability of the container to withstand horizontal forces of the hoop stresses due to the internal head pressure of fluid. The deep ribs give the strength to better withstand vertical downward forces of stacking loads without buckling.

In accordance with yet another aspect of the invention, the comers of the bottle wrap around more than 90° to define a column. This column design withstands vertical downward forces of stacking loads without buckling.

Further features and advantages of the invention will be readily apparent from the specification and from the drawing.

DETAILED DESCRIPTION OF THE INVENTION

Figure 1:
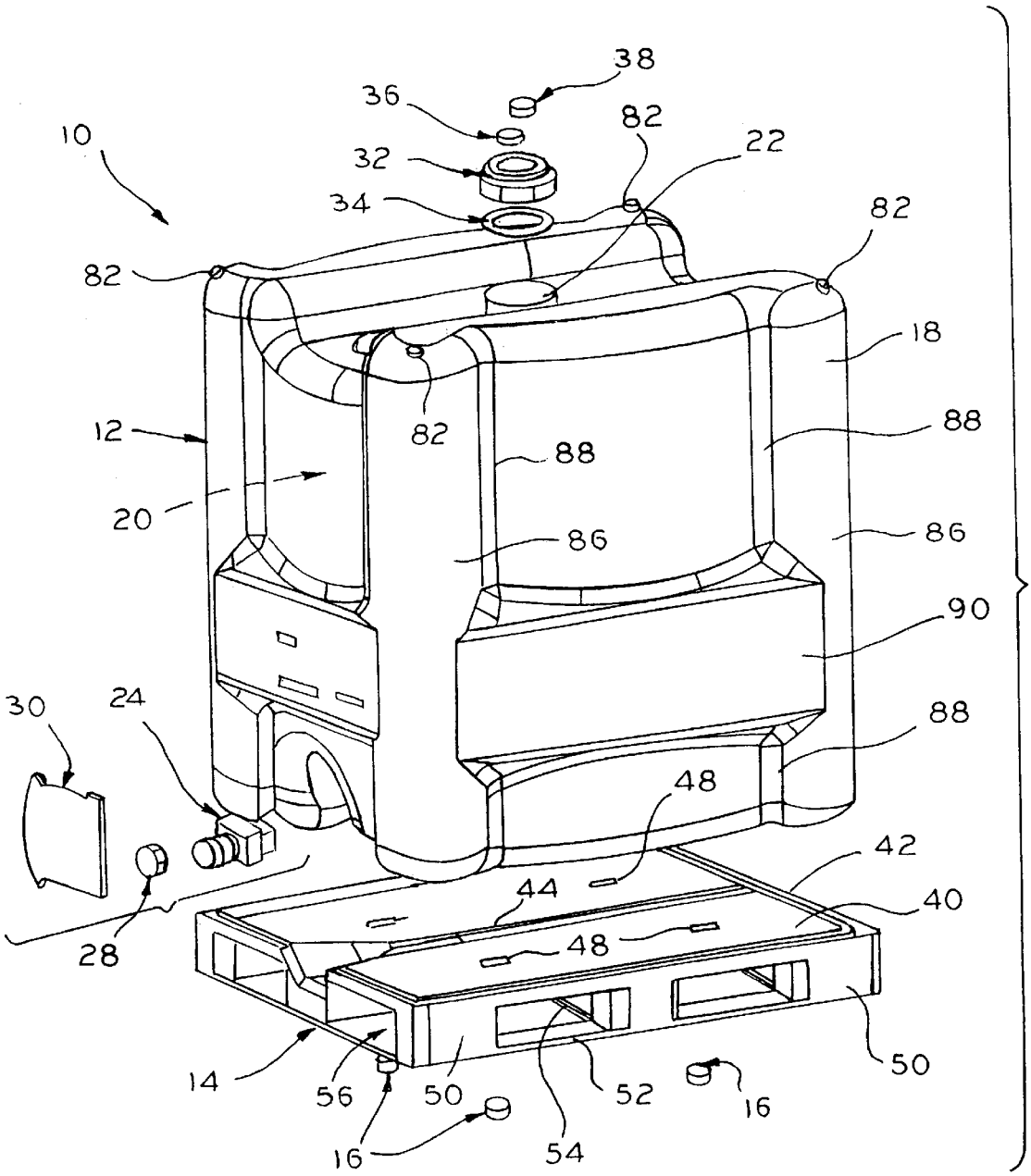
FIG. 1 is an exploded, perspective view of a bulk packaging container in the form of an intermediate bulk container in accordance with the invention.
Figure 2:
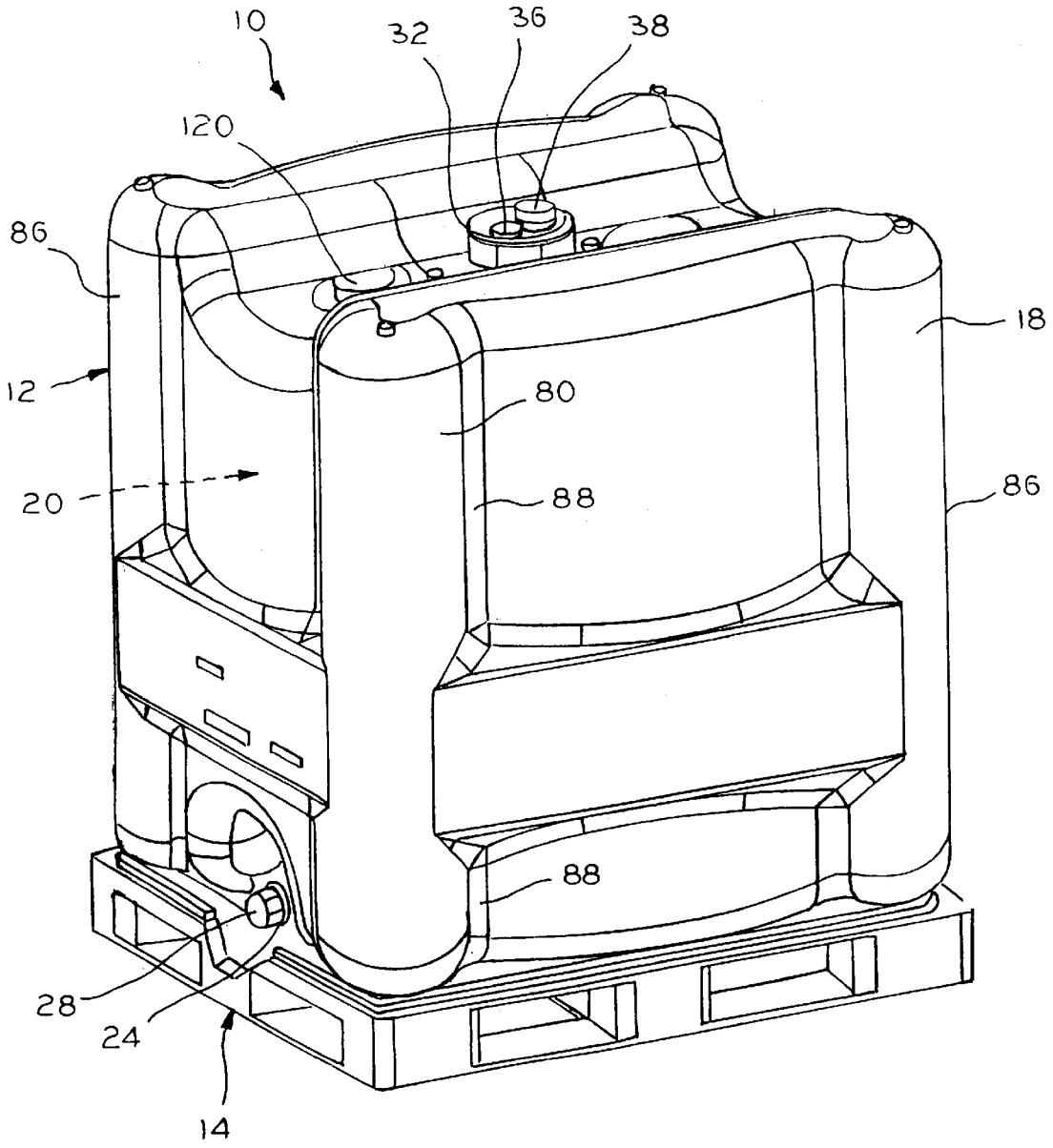
FIG. 2 is a perspective view of the IBC of FIG. 1 with a door omitted.
Figure 3:
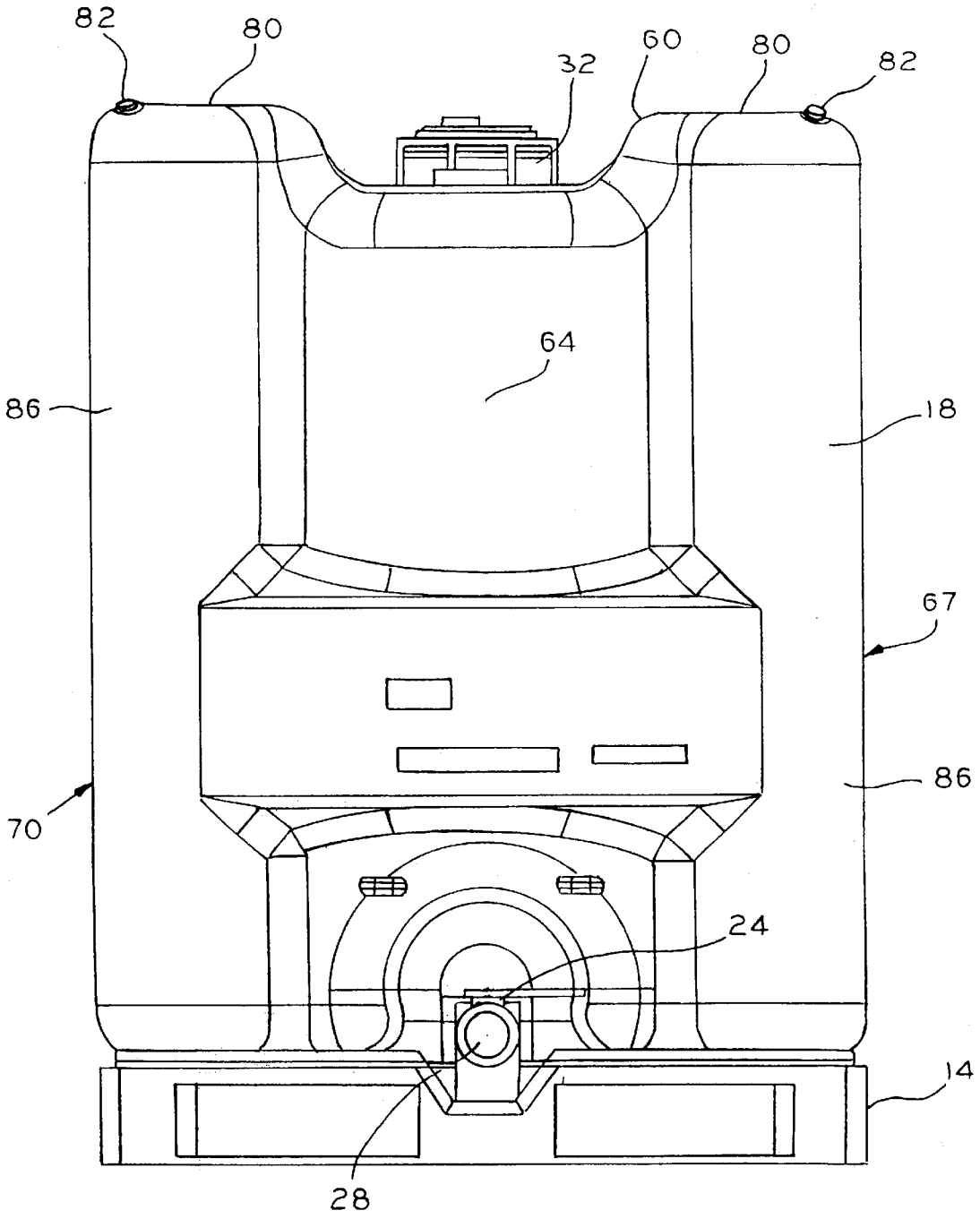
FIG. 3 is a front elevation view of the IBC of FIG. 2.
Figure 4:
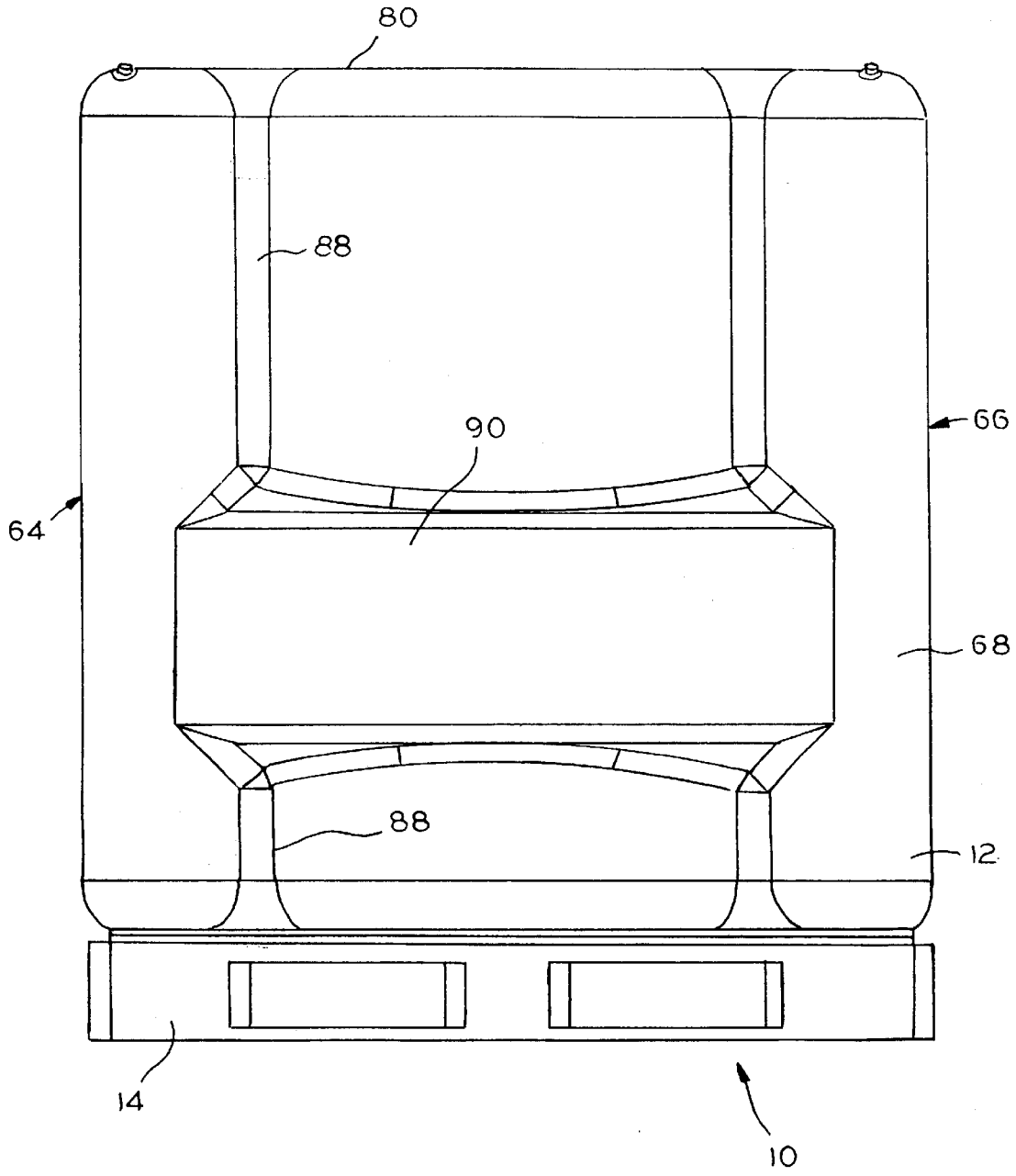
FIG. 4 is a right side elevation view of the IBC of FIG. 2.

Referring to FIGS. 1 and 2, a bulk packaging container constructed of all polymeric materials in accordance with the invention is illustrated. In the illustrated embodiment of the invention, the container 10 comprises a portable tank, in the form of an intermediate bulk container (IBC).

The terms bulk packaging, IBC, and portable tank define container units as described in various U.N., F.D.A. and D.O.T. regulations. Particularly, the IBC 10 comprises a rigid plastic IBC as specified at 49 CFR Section 178.706.

The IBC 10 includes a 330 gallon bottle 12 which is secured atop a pallet or base 14 using plural pallet bolts 16. The bottle 12 is of a rotationally molded polymeric material having an outer wall 18 defining an interior storage space 20. The storage space 20 can be filled via a top inlet opening 22. The bottle 12 can be emptied via a valve 24 secured to a spout 26, see FIG. 6. A dust cap 28 is provided for covering the end of the valve 24. A removable door 30, shown only in FIG. 1, also covers the ball valve 24 when not in use. The top opening 22 is normally closed with a lid 32 sealed with an 0-ring 34. The lid 32 includes plural openings selectively closed with a bung 36 and a vent 38.

The base 14 is of injection molded polymeric material such as high density polyethylene. By using injection molding, the cost of the base 14 is approximately one-fourth that of prior rotationally molded bases. This is because the injection molding process is less labor intensive and allows use of fewer pounds of material, because it allows the processing of stronger resins, and because the process allows for more efficient utilization of the se materials in the structural design. The injection molded base 14 allows greater weight efficiency for the same reasons. This is especially important because the cost of shipping is largely dependent on the amount of weight being shipped. Cost savings can be substantial, as there may be hundreds of shipments for each container.

The injection molding process allows stronger and tougher resins to be utilized where they are most important, in the base 14 of the container 10. The base 14 must withstand abuse such as a 0° F. drop test where the entire weight of the filled tank is dropped from a height specified by the D.O.T. and U.N. regulations. The base 14 is required to protect the bottle 12 from damage that would cause a leak, and to protect the base 14 itself from damage that would render the container not movable. Also, the injection molding process does not require extra spaces within the mold compared to that of a rotationally molded base, so that the IBC or portable tank base is made at a significantly shorter height. In fact, in the illustrated embodiment of the invention, the height of the base 14 is approximately six inches, compared to a height of approximately fourteen inches for a rotationally molded base.

Figure 7:
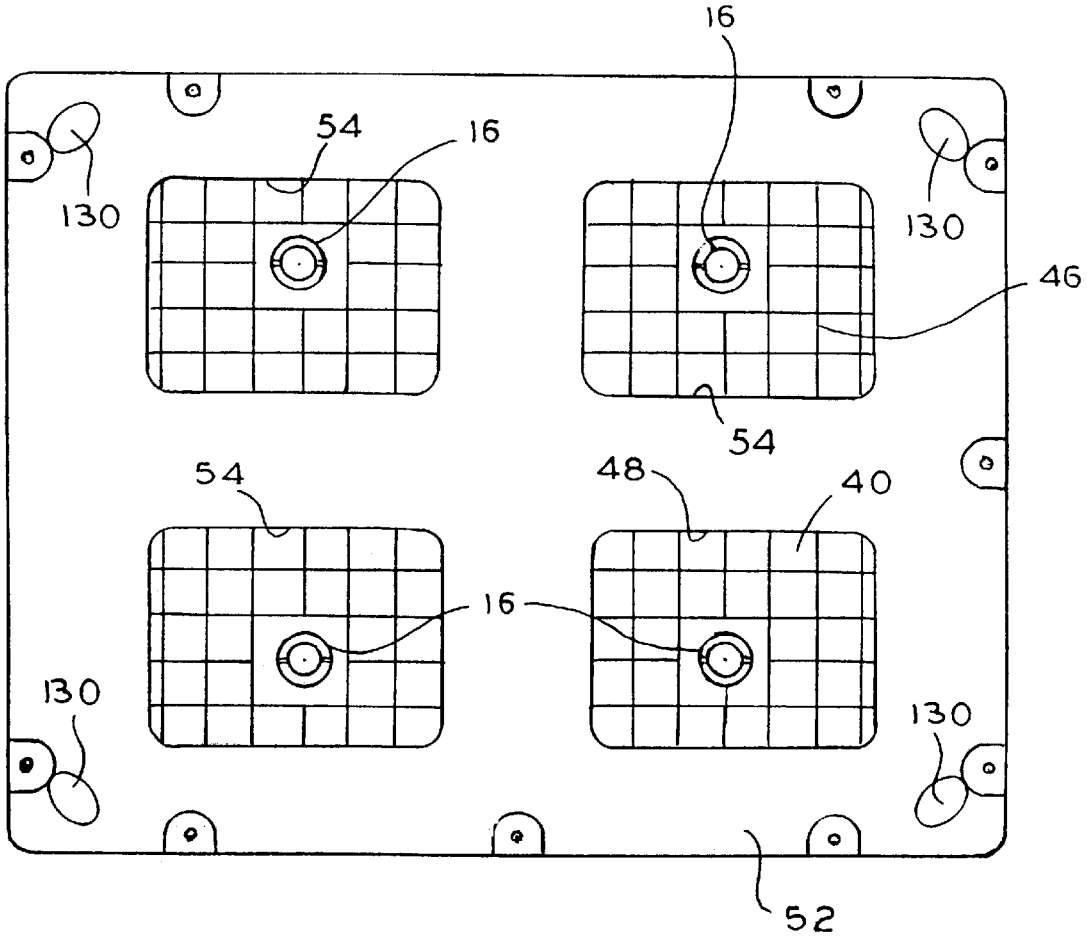
FIG. 7 is a bottom plan view of the IBC of FIG. 2.

Referring also to FIG. 7, the base 14 is of one-piece molded plastic construction. The base 14 includes a top 40 which is generally planar and surrounded by a peripheral contoured edge 42 for positioning the bottle 12. A sloped groove 44 is centrally longitudinally located on the top 40 to adapt to the bottle 12 to facilitate drainage. The underside of the top 40 includes a rib structure 44 to provide increased strength while using minimal plastic material. The top 40 includes four openings 48 through which the bolts 16 extend to fasten the bottle 12 to the base 14. Posts 50 are provided at each corner, intermediate each pair of corners, and in the middle of the top 40 for spacing the top from a bottom 52. The bottom 52 comprises a generally planar structure including four rectangular openings 54 positioned about each of the openings 48. Each pair of adjacent posts 50, the bottom 52 and top 40 define entry slots 56 for a forklift or pallet jack entry.

The bottom 52 is generally planar and is approximately one-halfinch thick. However, proximate the fork openings 56, the bottom 52 has a sloped ramp edge down to approximately 3/16" thick. This allows forklift drivers to skim the forks along the floor as they approach the container 10 to lift it.

The bottle 12 is rotationally molded of polymeric material such as plastic. The bottle 12 may be molded of a high density polyethylene or low density polyethylene. The wall 18 is molded to include a top wall 60, a bottom wall 62, a front wall 64, a rear wall 66, and opposite side walls 68 and 70.

Figure 6:
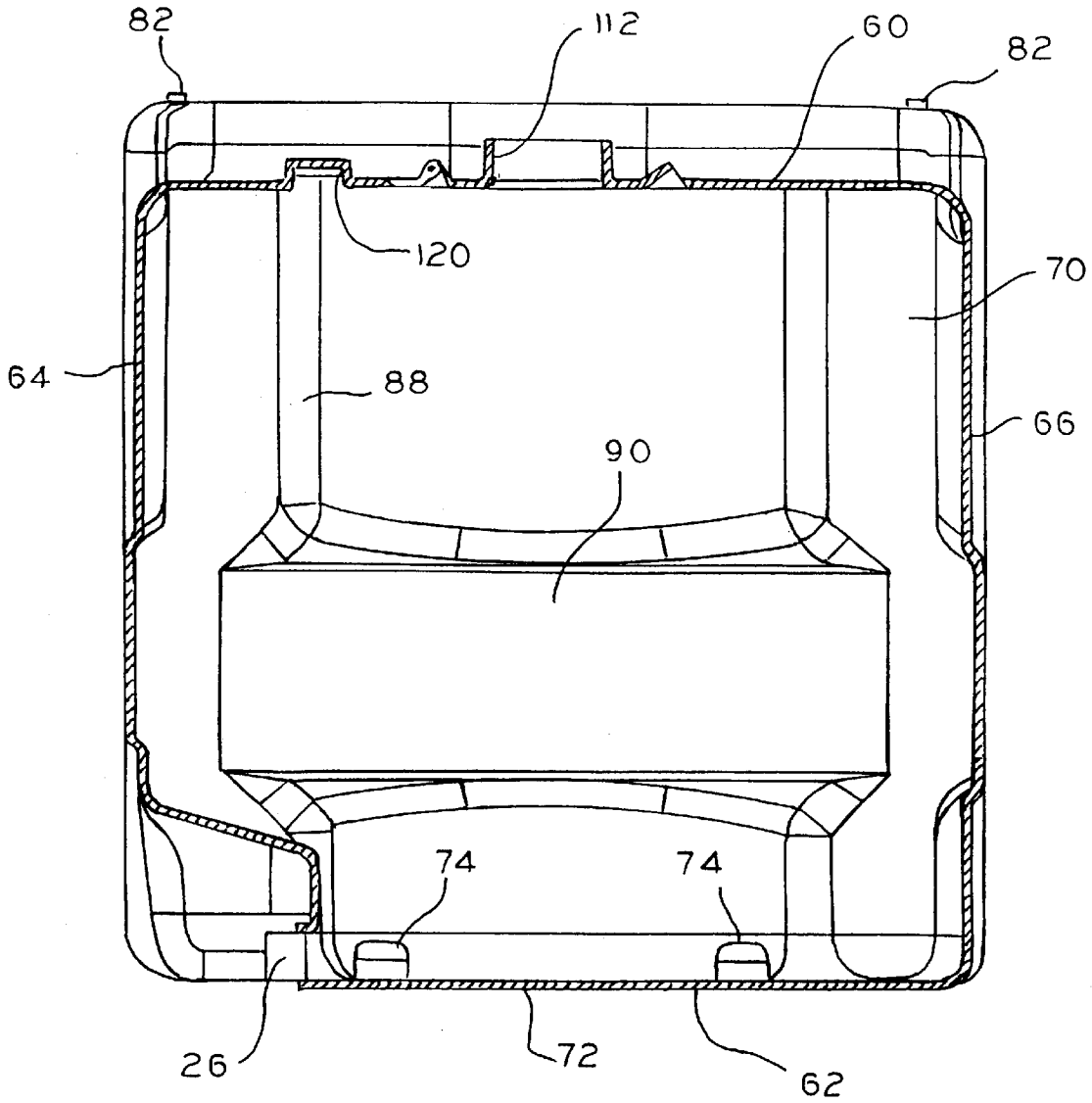
FIG. 6 is a sectional view of a bottle of the IBC taken along the line 6—6 of FIG. 5.
Figure 8:
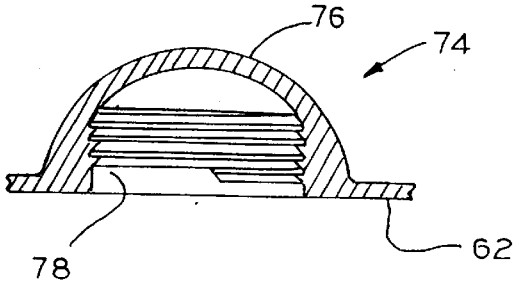
FIG. 8 is a sectional view of a pallet mount formed at the bottom of the bottle of the IBC of FIG. 2.

The bottom wall 62 is generally planar and includes a central sloped portion 72, see FIG. 6, to facilitate drainage. The sloped portion 72 is received in the base slot 44. The slope portion 72 terminates at the spout 26. The bottom wall 62 also includes four pallet mounts 74, one for each bolt 16. The pallet mount 74 is illustrated in FIG. 8 and comprises a semispherical wall 76 having a downwardly opening threaded recessed area 78. The bottle 12 is secured to the base 14 by threading the bolts 16 upwardly through the openings 48 into the threaded recessed area 78.

Figure 9:
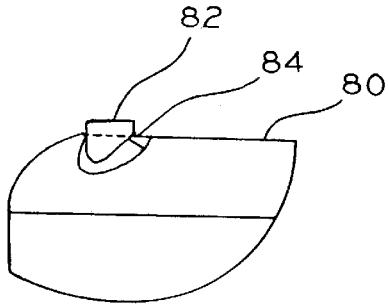
FIG. 9 is a detailed view of a stacking guide integrally molded in the bottle of the IBC of FIG. 2.

The top wall 60 includes raised side portions 80 connecting a recessed central portion 81. The central portion 81 is recessed so that the lid 32 is positioned below the side portions 80 to not interfere with stacking of multiple containers. Proximate each corner of the top wall 60 is a stacking guide 82. The stacking guide 82 is illustrated in greater detail in FIG. 9. The shape of the stacking guide 82 is round and conical to evenly and effectively collect resin within to fill the stacking guides during the rotational molding process. The longest horizontal dimension of the stacking guide 82 is approximately 1.25 inches, as illustrated, which is only approximately three times the wall thickness of the bottle 12. The height of the stacking guide 82 is approximately 0.375 inches, which is approximately equal to the wall thickness. A rigid plastic IBC or portable tank bottle wall thickness is normally in the range of 0.25 inches to 0.5 inches, with 0.375" being typical. The stacking guide 82 looking downwardly is generally circular and widens as at 84 at the juncture with the top wall 60 to provide a generally conical construction.

Figure 5:
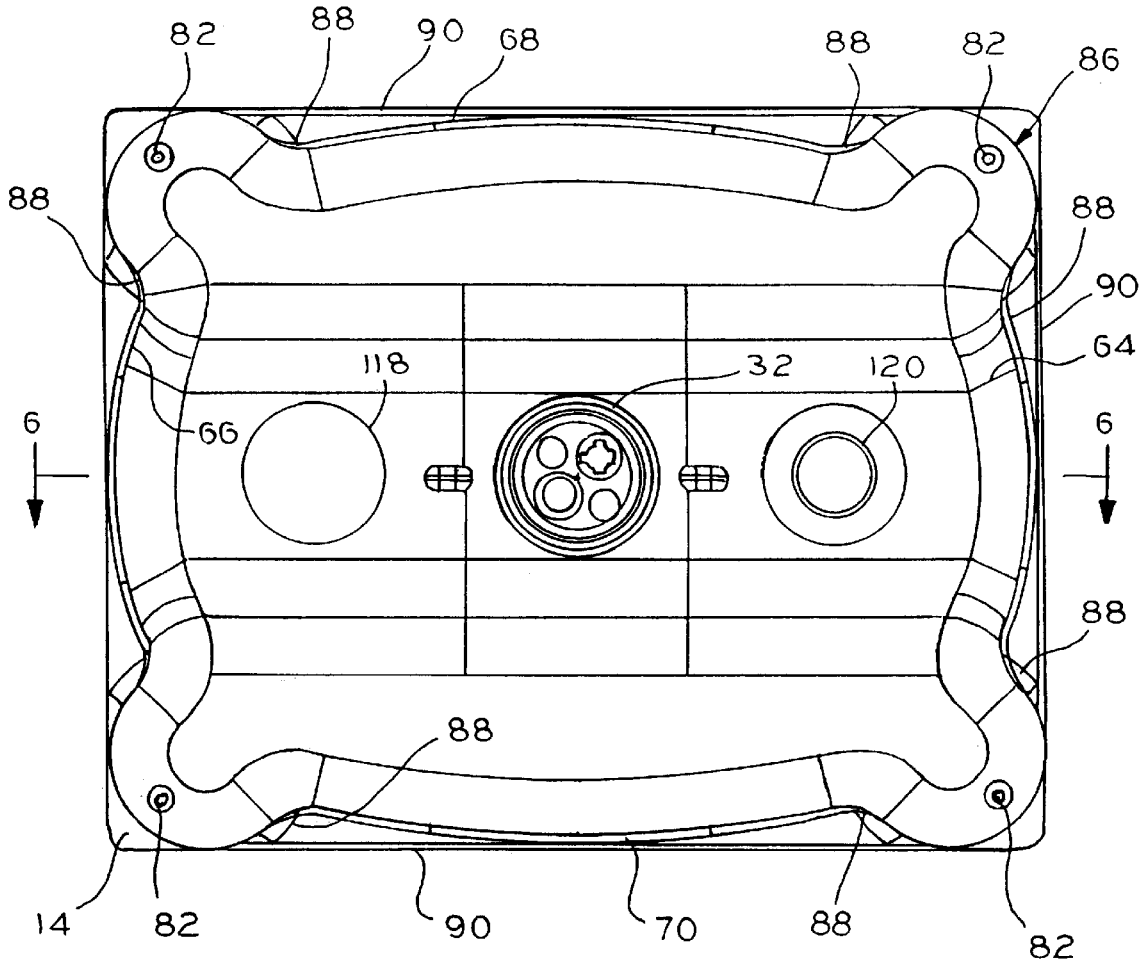
FIG. 5 is a top plan view of the IBC of FIG. 2.

A conventional plastic bottle for an IBC or portable tank has side walls connected at corners that wrap around approximately 90°. In accordance with the invention, the bottle 12 includes corners 86 that wrap around approximately 180° as is particularly illustrated in FIG. 5. This wraparound structure of the corners defines a column which adds strength to better withstand vertical downward forces of stacking loads. The vertical junction between each column 86 and adjacent walls, such as the front wall 64 and the right side wall 68, is a deep vertical rib 88. In accordance with the invention, the rib 88 has a depth of approximately 2.17 inches. As shown in any of FIGS. 1–4, the vertical rib 88 runs upwardly from the bottom wall 62 approximately twenty-five percent of the height. Similarly, the rib 88 runs downwardly from the top side portion 80 approximately fifty percent of the total height. A horizontal band or flat side wall portion 90 is provided therebetween. As is illustrated, the walls are contoured between the horizontal bands 90 and the upper and lower portions utilizing the deep vertical ribs 88.

The combination of the deep ribs 88 and the flat horizontal bands 90 provides improved structural strength. Particularly, the horizontal band 90 with no vertical ribs improves the ability of the bottle 12 to withstand the horizontal forces of hoop stresses due to the internal head pressure of a fluid without the problem of unfolding deep vertical ribs. The deep ribs 88 part way up and down the sides from the bottom and top of the bottle, respectively, give the bottle 12 strength to better withstand vertically downward forces of stacking loads without buckling as shallower ribs would tend to do.

In accordance with the invention, the bottle 12 is molded so that the top central portion 81 has three positions for possible openings. Particularly, during the molding process the locations and sizes of molded openings can be quickly and easily changed. This is done by creating three identical opening attachment devices in the mold which will accommodate an insert which molds the desired type of opening.

Figure 10:
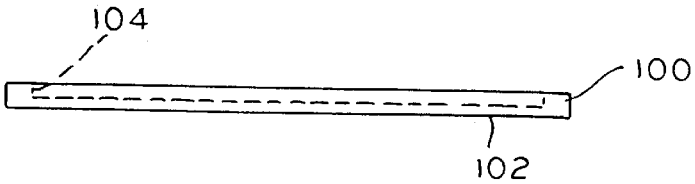
FIG. 10 is a side view of an insert ring utilized in a mold for forming the plastic bottle in accordance with the invention.

Referring to FIG. 10, an annular insert ring 100 is illustrated. The insert ring 100 is approximately ten inches in diameter and includes a throughbore 102 (illustrated in phantom) of approximately 8.55 inches and a coaxial counterbore 104 (illustrated in phantom) of approximately 9.06 inches in diameter.

Figure 15:
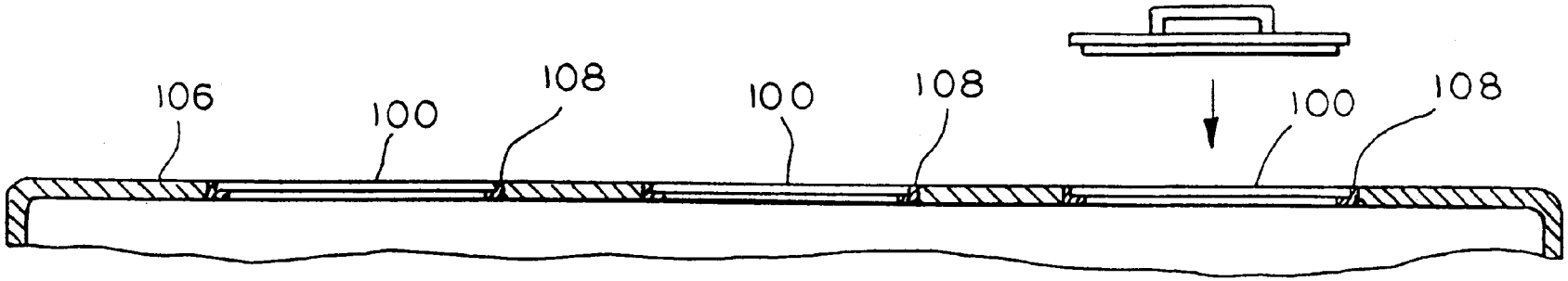
FIG. 15 is a side view of a mold.

Referring to FIG. 15, a mold 106 includes three openings 108 each receiving an insert ring 100. The insert rings 100 are welded in each opening 108 and ground and polished to be flush on the inside. The counterbore 104 faces outwardly. In accordance with the invention, an appropriate insert is then placed in each of the insert rings 100 and clamped down prior to rotationally molding the bottle 12.

Figure 11:
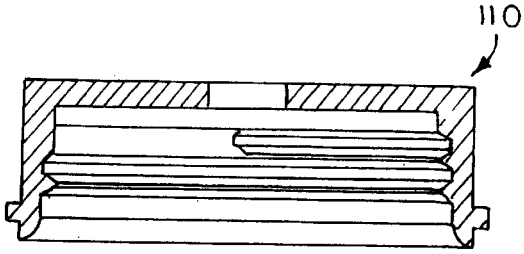
FIG. 11 is a sectional view of a roto molded fill cap insert used with the insert ring of FIG. 10.
Figure 13:
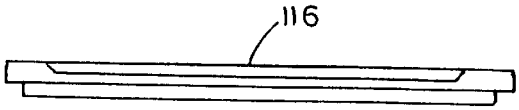
FIG. 13 is a side elevation view of an insert top flat blank used with the insert ring of FIG. 10.
Figure 14:
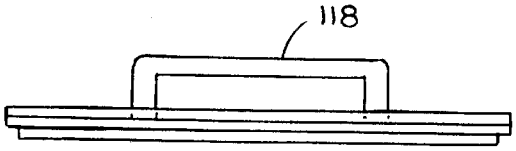
FIG. 14 is a side view of an top boss blank insert used with the insert ring of FIG. 10.

Examples of typical inserts are shown in FIGS. 11, 13 and 14.

Figure 12:
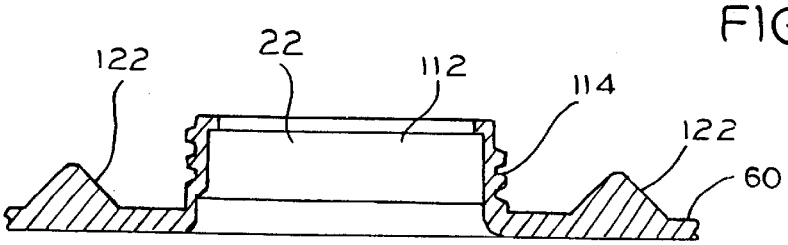
FIG. 12 is a sectional view showing a roto molded fill cap of the bottle of FIG. 2 formed using the insert of FIG. 11.

Referring initially to FIG. 11, a seven inch roto molded fill cap mold insert 110 is illustrated. This insert 110 molds a cylindrical collar 112 having an outer threaded surface 114, as shown in FIG. 12. This is used to produce the top opening 22, see FIG. 1, and receiving the lid 32.

Referring to FIG. 13, a top flat blank insert 116 is illustrated. This insert mounts essentially flush in the insert ring 100 to produce a plain circle shown at the position 118 of FIG. 5. Finally, FIG. 14 illustrates a top boss blank insert 118. This produces a raised boss 120, see FIGS. 2, 5 and 6.

Thus, as is apparent, any of the inserts 110, 116 and 118 can be positioned in any of the insert rings 100 in the mold 106 of FIG. 15 to provide no openings, one opening, two openings, or three openings, and any opening being of any select desired configuration according to the particular insert used. Other insert designs may be used, in accordance with the invention.

Although not shown in the mold 106 of FIG. 15, the top wall 60 includes lanyard loops 122. The lanyard loops 122 are used for securing the lid 32 using a lanyard or secure the lid 32 with a tie strap to provide a tamper-evident closure. The use of two lanyard loops, each disposed between adjacent pairs of the opening positions, can be shared with any of the three locations. The lanyard loops 122 are positioned in the same locations regardless of the position of the openings.

In the illustrated embodiment of the invention, the bottle 12 is approximately 39¼" wide and 47¼" deep. The total height of the container 10 is approximately 57¾" with the base 14 being approximately six inches high. This provides a bottle 12 which stores 330 gallons. Other storage capacities can be achieved by varying these dimensions.

Thus, in accordance with the invention, a portable tank or IBC 10 is manufactured by providing a rotationally molded bottle 12 and injection molded base 14 and securing the same together using fasteners 16. Moreover, the various openings in the bottle 12 can be selectively configured as desired using inserts, including inserts 110, 116 and 118, selectively secured in the three insert rings 100 in the mold 106 of FIG. 15. The use of the injection molded base along with the rotationally molded bottle provides a container 10 having the advantages of a rotationally molded bottle capable of vertical stacking in a rigid plastic IBC or portable tank while also made at a significantly shorter height. This provides better space efficiency in either a transport vehicle or a storage warehouse. Also, the production costs and shipping costs are substantially less to reduce overall life cycle costs of these types of containers.

The stacking guides 82 are configured to be filled almost completely with plastic during the rotational molding process. This eliminates any cavities on the interior upper surface of the bottle. The stacking guides 82 are adapted to be received in appropriate recesses 130 provided in the base bottom 52 as shown in FIG. 7. The recesses 130 are approximately 0.375 inches deep, corresponding with the height of the stacking guides 82. This facilitates alignment of the containers 10 for stacking. The use of the corner columns 86 in conjunction with the deep vertical ribs 88 and flat horizontal bands 90 allows the bottle 12 to withstand horizontal forces of hoop stresses due to internal head pressure of fluid while giving strength to better withstand vertically downwardly forces of stacking loads.

Thus, in accordance with the invention there is provided a bulk packaging container made of all polymeric materials being of reduced height and weight by using the rotationally molded bottle and an injection molded base.

We claim:

1. A bulk packaging container, constructed of all polymeric materials, in the form of a rigid plastic intermediate bulk container or portable tank, comprising:

a base of an injection molded polymeric material having a bottom wall adapted to be supported from beneath and an opposite top wall to define a height of approximately six inches and including plural entry slots for forklift or pallet jack entry between the bottom wall and the top wall;

a bottle of a rotationally molded polymeric material having an outer wall defining a an interior storage space, the outer wall comprising a bottom wall received on the base top wall and a top wall including means for supporting a base of another bulk packaging container, the bottle being adapted to support weight of the other bulk packaging container; and means for securing the bottle to the base.

2. The bulk packaging container of claim 1 wherein an underside of the base top wall has a rib structure.

3. The bulk packaging container of claim 1 wherein the top wall has plural openings and the securing means comprises threaded fasteners extending through the openings and received in bottle.

4. The bulk packaging container of claim 3 wherein the bottle bottom wall includes downwardly opening threaded recessed areas receiving the fasteners.

5. The bulk packaging container of claim 1 wherein the supporting means are integrally formed in the bottle top wall for directly supporting the base of the other bulk packaging container.

6. The bulk packaging container of claim 1 wherein the supporting means comprises stacking guides extending upwardly from the bottle top wall proximate each corner thereof.

7. The bulk packaging container of claim 6 wherein the stacking guides are generally conical.

8. The bulk packaging container of claim 6 wherein the stacking guides extend upwardly from the bottle top wall an amount similar to a thickness of the bottle top wall.

9. The bulk packaging container of claim 6 wherein the stacking guides have a horizontal dimension about three times a thickness of the bottle top wall.

10. The bulk packaging container of claim 1 wherein the bottle includes columns extending between the bottle top wall and the bottle bottom wall at each corner thereof.

11. A bulk packaging container in the form of an intermediate bulk container or portable tank, comprising:

a base; and a bottle of a rotationally molded polymeric material having an outer wall defining a an interior storage space, the outer wall comprising a bottom wall received on the base, a top wall adapted to support a base of another bulk packaging container, a side including a front wall, a rear wall and opposite side walls each extending between the top wall and the bottom wall, and comer columns extending between the top wall and the bottom wall at each corner thereof, each column connecting one of the side walls to one of the front wall or the rear wall, wherein the bottle is adapted to support weight of another bulk packaging container.

12. The bulk packaging container of claim 11 wherein the side at each corner wraps around approximately 180 degrees to define the corner columns.

13. The bulk packaging container of claim 11 wherein side walls, said front wall and said rear wall each includes a horizontal band extending outwardly therefrom between the corner columns to withstand horizontal forces.

14. The bulk packaging container of claim 13 wherein the side includes ribs extending vertically between the horizontal band and the top wall and between the horizontal band and the bottom wall to withstand vertical forces.

15. The bulk packaging container of claim 14 wherein the ribs are formed at a junction between each corner column and the side walls, the front wall and the rear wall.

16. The bulk packaging container of claim 11 wherein the side includes plural vertically extending ribs to withstand vertical forces.

17. The bulk packaging container of claim 16 wherein the ribs are formed at a junction between each corner column and the side walls, the front wall and the rear wall.

18. The bulk packaging container of claim 11 further comprising stacking guides extending upwardly from the top wall proximate each corner thereof.

19. The bulk packaging container of claim 18 wherein the stacking guides are generally conical and extend upwardly from the top wall an amount similar to a thickness of the top wall and have a horizontal dimension about three times the thickness of the top wall.

20. A method of manufacturing a bulk packaging container, in the form of a rigid plastic intermediate bulk container or portable tank, constructed of all polymeric materials, comprising:

injection molding a base of a polymeric material and having a bottom adapted to be supported from beneath and an opposite top to define a height of approximately six inches and including plural entry slots for forklift or pallet jack entry;

rotationally molding a bottle of a polymeric material and having an outer wall defining an interior storage space, the outer wall comprising a bottom wall received on the base top and a top wall adapted to directly support a base of another bulk packaging container; and providing fasteners for securing the bottle to the base.

21. The method of claim 20 wherein the rotationally molding step comprises providing a mold having three opening attachment devices each accommodating an insert for selectively molding openings at up to three locations in the top wall of the bottle.

22. The method of claim 21 wherein the providing step comprises including insert rings at three opening of the mold corresponding to the three locations.

23. The method of claim 22 wherein each insert ring is welded in one of the mold openings.

24. The method of claim 22 wherein the insert is selected from a group providing a fill cap opening, a raised boss and no opening.

25. The method of claim 21 wherein the three locations are aligned and the rotationally molding step further comprises molding a lanyard loop between each adjacent pair of the three locations.

26. The method of claim 20 wherein the rotationally molding step further comprises integrally forming stacking guides extending upwardly from the bottle top wall proximate each corner thereof for directly supporting the base of the other bulk packaging container.

27. The method of claim 26 wherein the stacking guides are generally conical and extend upwardly from the top wall an amount similar to a thickness of the top wall and have a horizontal dimension about three times the thickness of the top wall.

28. The method of claim 26 wherein the stacking guides are almost completely filled with plastic during the rotationally molding step.

* * * * *